United States Patent [19]

Ellis

[11] 4,304,611

[45] Dec. 8, 1981

[54] METHOD AND APPARATUS FOR CLEANING CONTAINER CLOSURES

[75] Inventor: Darwin L. Ellis, Richmond, Ind.

[73] Assignee: Aluminum Company of America, Pittsburgh, Pa.

[21] Appl. No.: 143,194

[22] Filed: Apr. 24, 1980

[51] Int. Cl.[3] ..... B08B 3/02; B08B 9/00

[52] U.S. Cl. ..... 134/23; 15/302; 15/304; 15/306 B; 134/30; 134/36; 134/37; 134/72; 134/83; 134/127

[58] Field of Search ..... 134/23, 25.4, 30, 36, 134/37, 70, 72, 82, 83, 127, 169 R; 198/817, 841, 957; 15/302, 304, 306 B

[56] References Cited

U.S. PATENT DOCUMENTS

| | | | |
|---|---|---|---|
| Re. 25,486 | 11/1963 | Nolte | 134/30 X |
| 1,689,757 | 10/1928 | Taylor . | |
| 1,824,858 | 9/1931 | Williams | 198/841 X |
| 2,367,393 | 1/1945 | Green . | |
| 2,633,437 | 3/1953 | Detjen | 134/23 X |
| 2,917,768 | 12/1959 | Walberer . | |
| 2,957,572 | 10/1960 | Dvorak | 198/817 X |
| 3,570,505 | 3/1971 | Randall | 134/72 |
| 3,965,523 | 6/1976 | Elliott . | |
| 4,167,797 | 9/1979 | Wilde et al. . | |

*Primary Examiner*—Marc L. Caroff
*Attorney, Agent, or Firm*—Glenn E. Klepac

[57] ABSTRACT

Apparatus and method for cleaning container closures during downward travel in an elongated vertical pathway from a hopper to a capping machine. The apparatus includes liquid and gas spray means for directing generally horizontal fluid streams against vertically oriented inner surface portions of the closures, an enclosure, and a drain for removing liquid from the enclosure. A belt means engages closures traveling through the apparatus, thereby forcing the closures past the liquid and gas spray means and controlling their rate of travel. In a preferred embodiment, the belt means comprises several laterally spaced flexible endless belts each having a principal section frictionally engaging outer surface portions of the closures. An additional feature of the preferred embodiment is a perforated plate adjacent an interior surface portion of the principal section.

10 Claims, 7 Drawing Figures

METHOD AND APPARATUS FOR CLEANING CONTAINER CLOSURES

BACKGROUND OF THE INVENTION

The present invention relates to an apparatus and method for cleaning container closures by removal of contaminants shortly before the closures are applied to bottles or other containers by a capping machine. More particularly, this invention relates to an apparatus and method for directing sprays of liquid and gas against inner surface portions of the closures, while forcing the closures along a chute leading to the capping machine.

Thorough cleansing of closure interiors poses a difficult problem inasmuch as the closures may be traveling from hopper to capping machine at rates of 250 to 1000 closures per minute, and typically travel at a rate of about 400 to 800 closures per minute. A multiplicity of waxes, oils and pigments is applied to the closure interiors for various purposes, further increasing the difficulty of removing contaminants. Waxes and oils on interior surface portions of the closures may bond particulate contaminants to the closure surface. Although the types of particulate contaminants usually found on closure surfaces do not normally pose a health hazard, these particulates may be visible to the consumer, thereby deleteriously affecting consumer acceptance of the packaged product.

Several devices similar to the closure cleaning apparatus of the present invention have been developed in the prior art. However, each of these prior art devices suffers from one or more serious limitations making it less than completely suitable for its intended purpose.

For example, Green U.S. Pat. No. 2,367,393 discloses a closure cleaning device including a compressed air jet directed toward the interiors of closures passing down a chute from a hopper to a capping machine head. However, the Green device lacks any provision for cleaning the closures by means of water or other liquid, and directs its air stream at an acute angle to the flat cap portions of the closures. This angularly oriented air stream is intended to assist movement of the closures along the chute and through a suction zone where contaminants are removed. The Green device lacks any means for controlling velocity of closures moving down the chute, thereby limiting thoroughness of cleaning necessary to assure consistent quality control in the finished product.

A more sophisticated closure cleaning device is shown in Wilde et al U.S. Pat. No. 4,167,797, issued Sept. 18, 1979. This device is mounted at the terminal of a crown feed track just prior to the point where closures are transferred to the capping machine of a bottling line. The device includes a liquid spray jet and several air spray jets, each of which directs a fluid spray at an acute angle to closure caps passing down the feed track. Unlike the apparatus of the present invention, the Wilde et al device lacks any provision for directing a fluid spray generally perpendicular to the cap interiors and does not control velocity of the closures by means of a belt engaging the closures.

Elliott U.S. Pat. No. 3,965,523 discloses a bearing washing machine for cleaning bearings having a large diameter, generally cylindrical outer race and a smaller diameter, generally cylindrical inner race connected to the outer race and concentric therewith. The washer conveys the bearings through a housing on two laterally spaced, parallel chains. Diametrically opposite portions of each outer race are supported on the chains with the inner race being freely rotatable during passage through the housing. The chains are driven by a motor to pass underneath a sequence of washing solution nozzles 42, high pressure air nozzles 45 and drying air hoses 46. However, in order to urge inner races of the bearings into rotation, the washing nozzles 42, high pressure air nozzles 45 and low pressure nozzle 47 are directed toward the inner races in a downwardly oblique direction, as shown in FIGS. 7 and 8. In contrast, in the present invention, it has been found highly desirable to direct sprays of cleaning water and air generally normal to the inner surfaces of closure caps rather than at an oblique angle. The cleaning apparatus of the present application also differs from Elliott's bearing washer in that there is here provided a dead plate adjacent inner surface portions of the principal section of the belts, thereby limiting inward displacement of the principal section upon exposure to high pressure sprays of water and air.

An apparatus for removing loose particles from can interiors is shown in Taylor U.S. Pat. No. 1,689,757. Cans passing sideways along a conveyor belt are flushed to remove loose particles and moisture by three air nozzles mounted parallel to the plane of the conveyor belt. The nozzles are inserted into the can interiors, thereby making the Taylor apparatus unsuitable for use in the high speed operations of modern packaging plants. Taylor further fails to suggest that the air nozzles should be directed normal to the plane of the conveyor belt rather than parallel thereto.

Walberer U.S. Pat. No. 2,917,768 discloses a machine for suction cleaning of wide-mouthed jars prior to filling in a canning factory. The jars are fed to a suction nozzle by passing along a conveyor belt. The Walberer patent lacks any suggestion that its means for suction cleaning of wide-mouthed jars should be combined with other prior art devices for removing contaminants from closure cap interiors.

SUMMARY OF THE INVENTION

In accordance with the present invention, there is provided an apparatus for removing contaminants from container closures while the closures are traveling from a hopper to a capping machine. The apparatus comprises a liquid spray means, a gas spray means, an enclosure for limiting spray of liquid beyond the apparatus and a belt means engaging closures traveling through the apparatus. The belt means forces closures past the liquid and gas spray means and controls the velocity of the closures.

A preferred belt means comprises a plurality of laterally spaced flexible endless belts of an organic polymeric material each having a principal section frictionally engaging outer surface portions of the closures. The principal section is backed by a plate for limiting displacement of the belts upon exposure to the liquid and gas spray means. In a preferred arrangement of the apparatus, sprays of atomized water and of air are directed generally normal to caps of the closures.

In a preferred embodiment, the belts are driven by a pair of pulleys mounted on parallel, longitudinally spaced axles. End portions of the belts pass longitudinally externally of the pulleys, and an air motor joined to one of the axles drives the pulleys at a controlled velocity.

It is a principal object of the present invention to provide an apparatus and method for cleaning container closures more thoroughly than prior art devices.

It is a related object of the invention to provide a belt means for forcing closures through a chute past liquid and gas spray means prior to applying the closures to containers in a capping machine.

It is an advantage of the invention that the apparatus described herein may be fitted to and mounted on the chutes of existing container capping machines.

Additional objects and advantages of the present invention will become apparent to persons skilled in the art from the following specification, considered in conjunction with the drawings

DETAILED DESCRIPTION OF A PREFERRED EMBODIMENT

Figure 1:
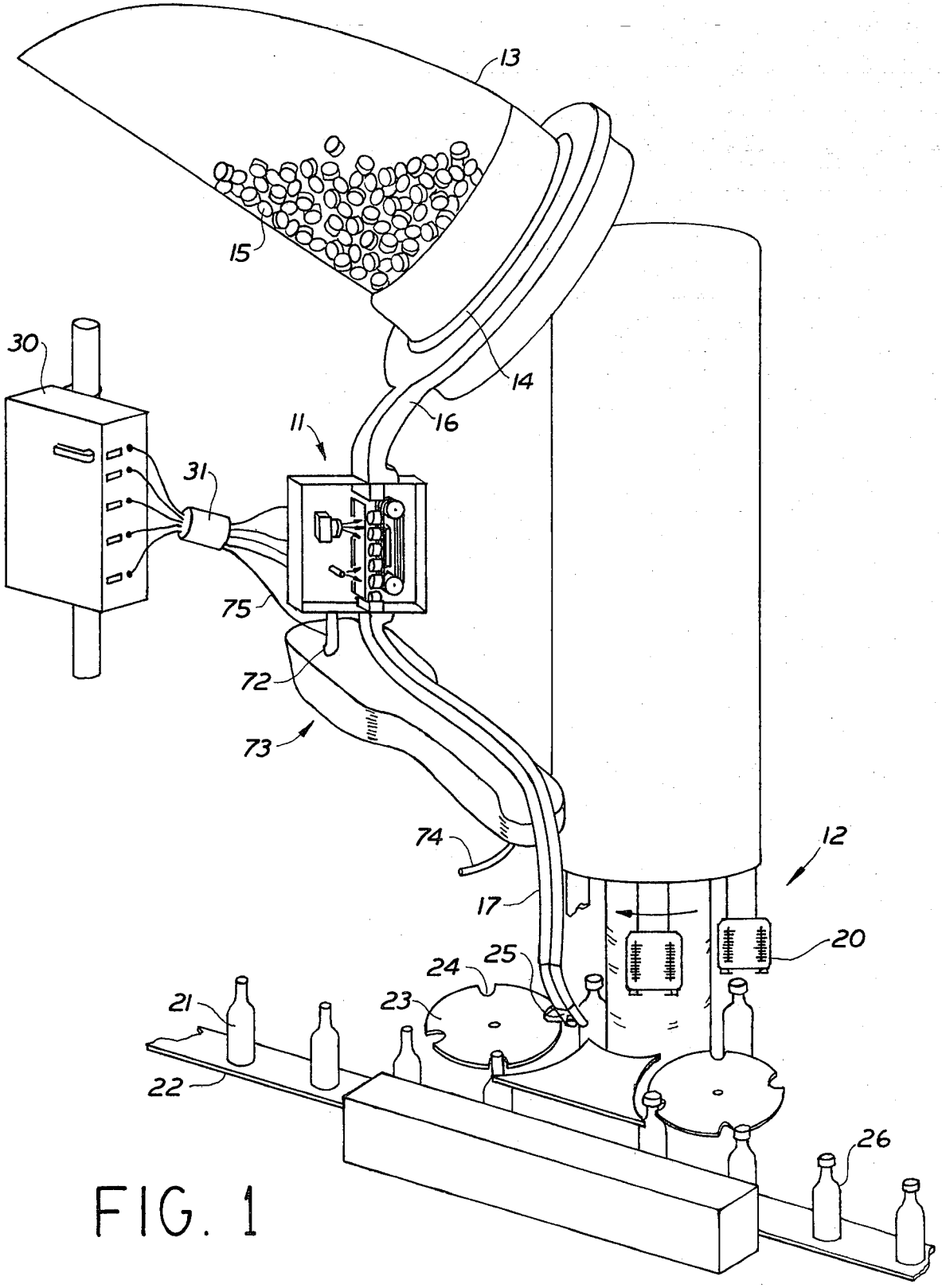
FIG. 1 is a perspective view of a container capping machine with a closure hopper and a chute, showing the closure cleaning apparatus of the invention.

The closure cleaning apparatus 11 of the invention is used in conjunction with a bottle capping machine 12 and a closure hopper 13, as shown in FIG. 1. An orienting device 14 transfers closures 15 from the hopper 13 to a discharge channel or upper chute 16. In the preferred embodiment illustrated and described herein, the closures 15 are metal (preferably aluminum), prethreaded bottle caps having a diameter of about 38 mm. Only minor modification of the apparatus is needed for different sized caps, such as 28 mm diameter caps, as explained below. The apparatus 11 may also be used for cleaning unthreaded or "roll-on" type bottle caps provided that the capping machine 12 is capable of making threads when such caps are applied to containers. The closures 15 are fed by gravity downwardly to the cleaning apparatus 11, where mechanical assistance is necessary for the closures 15 to continue their downward path. Closures processed by the apparatus are fed by gravity through a lower chute 17 to a capping machine 12.

The capping machine 12 includes capping heads 20 for sealing containers. In the preferred embodiment shown, the containers are bottles 21 filled with a beverage or other liquid. The filled bottles 21 move along a conveyor 22 to a star wheel 23 having several radially outwardly opening notch-shaped compartments 24. The star wheel 23 feeds bottles 21 individually at a controlled rate to a cap release device 25 where caps 15 from the chute 17 are released singly and applied one at a time to tops of the bottles 21. After capping heads 20 seal caps 15 to uncapped bottles 21, the capped bottles 26 are then conveyed to cartons (not shown) for shipment to customers.

The capping line shown in FIG. 1 is designed for high-speed operations wherein the capping machine 12 applies closures to bottles at a rate of at least 250 closures per minute, and closures are transported through the chutes 16, 17 at the same rate. The line is usually operated at a rate of about 400 to 600 closures per minute, although a rate of over 1,000 closures per minute is attainable.

An air and water control box 30 is provided at a remote location for housing all regulators, filters and valves necessary to service the apparatus 11. Air and water lines 31 extend from the control box 30 to the apparatus 11.

Figure 2:
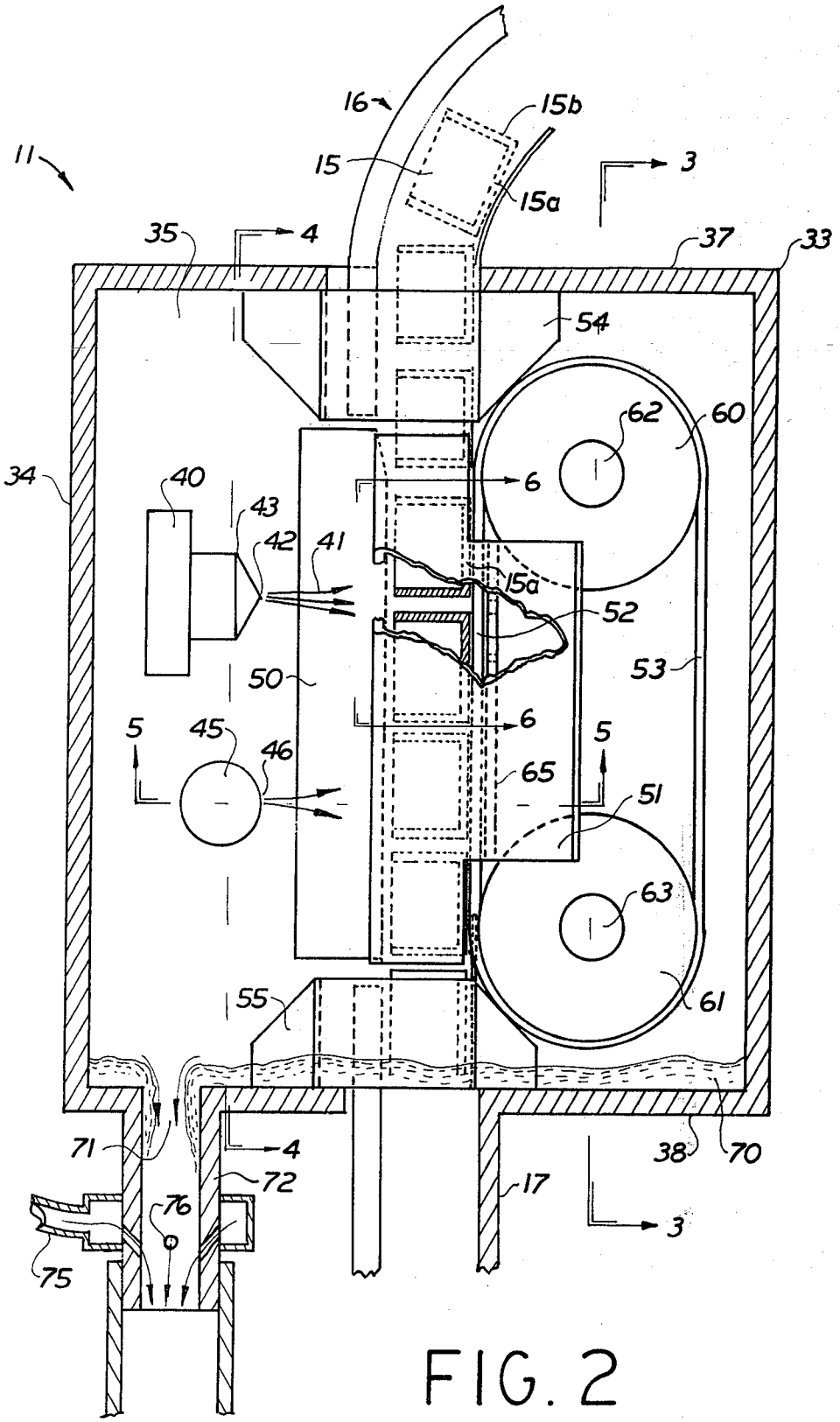
FIG. 2 is a fragmentary, front elevational view of the closure cleaning apparatus of the invention with the front door removed.
Figure 7:
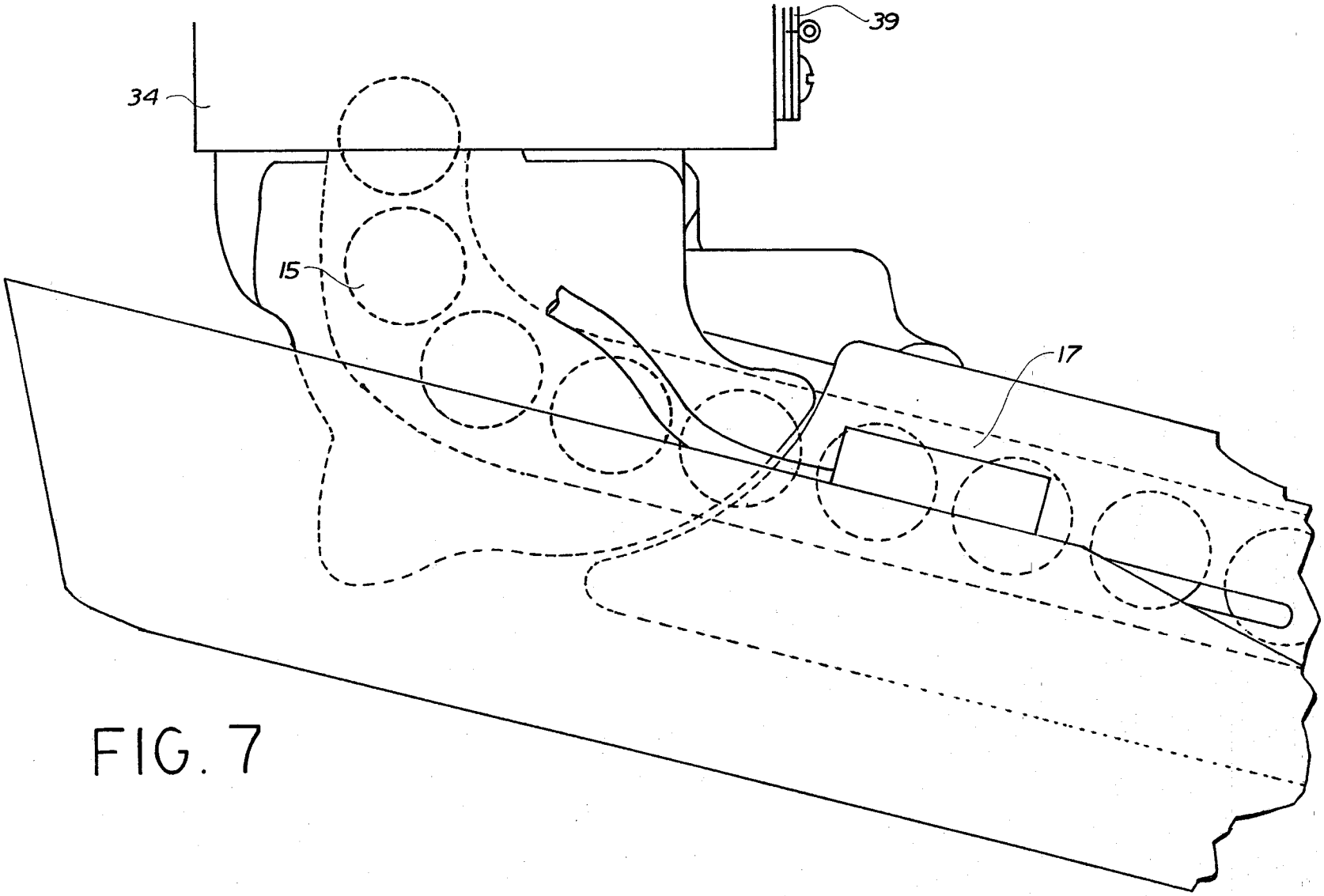
FIG. 7 is a fragmentary, side elevational view of a lower portion of the closure cleaning apparatus of the invention and a portion of the chute to which the apparatus is attached.

Referring now to FIGS. 2 and 7, the apparatus 11 is housed in an enclosure 33 having side walls 34, 35, 36, a top wall 37, a bottom wall 38 and a front door 39. To enhance clarity of illustration, the front door 39 is not shown in FIG. 1. Closures 15 moving down the chute 16 are fed to the cleaning apparatus 11 through an opening in the top wall 37. Closures 15 entering the apparatus each include generally flat cap portions or caps 15*a* and generally cylindrical skirt portions or skirts 15*b* extending outwardly of the cap portions 15*a*.

Figure 4:
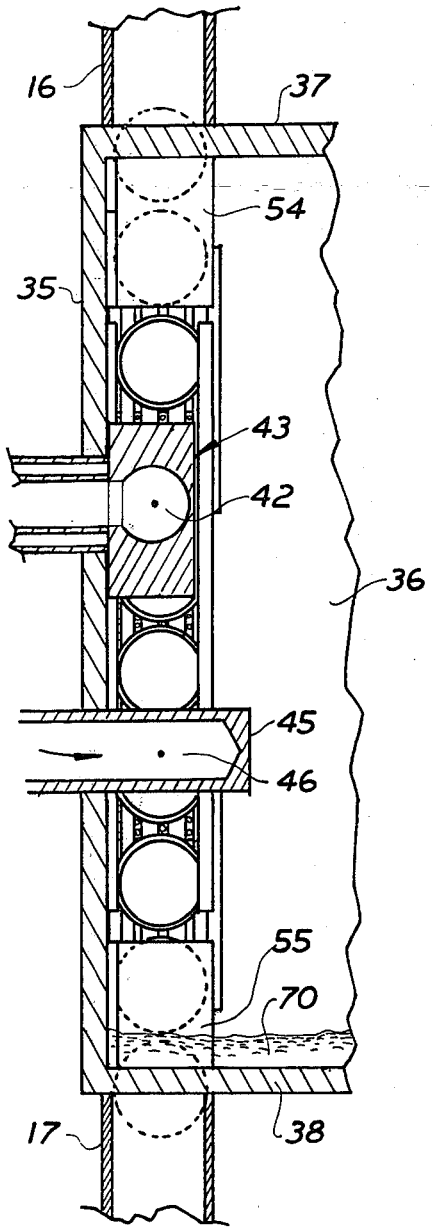
FIG. 4 is a fragmentary, cross-sectional view taken along the lines 4—4 of FIG. 2.

The cleaning apparatus 11 of the invention removes contaminants from the closures 15 by sequentially spraying them with atomized water and air, as shown in FIGS. 1, 2 and 4. Filtered water at a pressure of about 20 psi is supplied through control box 30 to an atomizing nozzle 40 where the water is mixed with air at a pressure of about 50 psi to form an atomized spray. The spray 41 is forced through an orifice 42 in a spray nozzle 43 in a direction generally normal to inner surfaces of cap portions 15*a* of closures 15 passing downwardly through the apparatus. A blow-off air nozzle 45 stationed downwardly of the water spray nozzle 43 is provided with filtered air at a pressure of about 55 psi. Pressurized air is sprayed through an orifice 46 in the nozzle 45 generally normal to inner surfaces of cap portions 15*a* of the closures 15.

Figure 5:
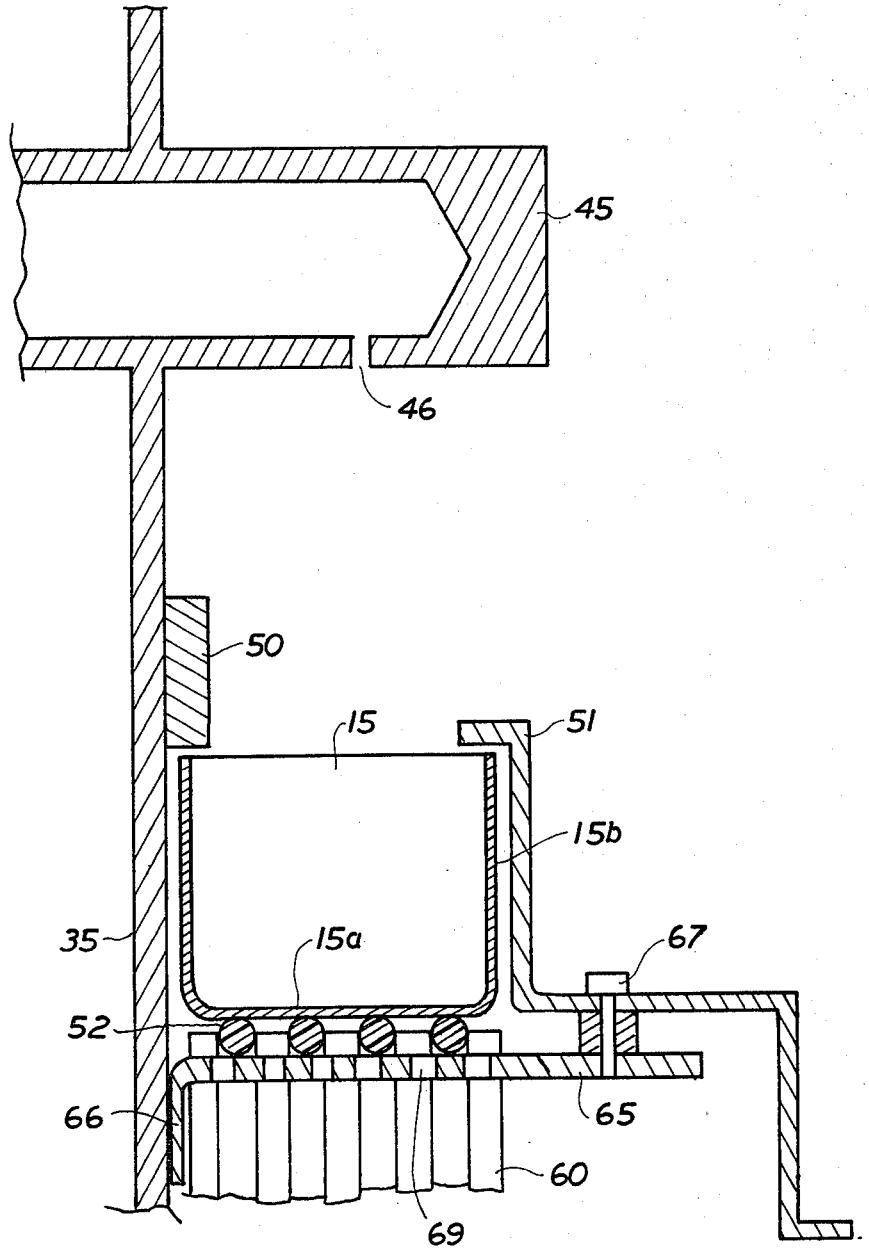
FIG. 5 is a fragmentary cross-sectional view taken along the lines 5—5 of FIG. 2.

Closures 15 passing through the apparatus are maintained in the same alignment as in the chute 16 by a guide rail 50 and guide bracket 51 in cooperation with the principal sections 52 of four rotating belts 53, shown in FIGS. 2 and 5. An intake baffle 54 adjacent the top wall 37 and a guide throat 55 adjacent the lower wall 38 also serve to maintain the closures 15 in a longitudinally aligned, linear array as they travel through the apparatus 11. The upper chute 16, guide rail 50, guide bracket 51, belts 53 and lower chute 17 define, in combination, a continuous elongated pathway for transferring the closures 15 in constant alignment from the hopper 13 to capping machine 12.

Figure 3:
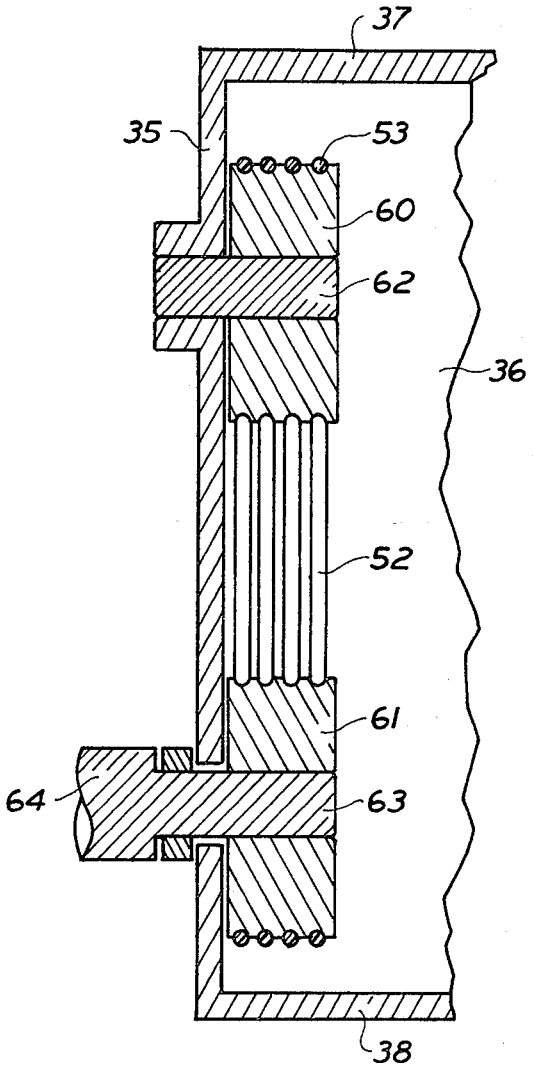
FIG. 3 is a fragmentary, cross-sectional view taken along lines 3—3 of FIG. 2.

The four belts 53 are flexible endless belts made from an organic polymeric material, preferably polyurethane. Other flexible rubber or plastic materials may also be used. The belts 53 are looped around upper and lower, longitudinally spaced pulleys 60, 61 mounted on respective parallel, upper and lower axles 62, 63 (see FIGS. 2 and 3). A journaled drive shaft 64 of an air motor (not shown) is coupled with the lower axle 63 to drive the belts 53 at a controlled speed. The air motor in the preferred embodiment described herein is a variable speed motor developing a maximum of 0.20 horsepower. Persons skilled in the art will understand that other variable speed motor means, including electric motors, may be substituted for the air motor if desired.

As shown in FIG. 5, outer surface portions of the belts 53 engage cap portions 15*a* of the closures 15, thereby carrying the closures 15 downwardly through the apparatus. The four belts 53 constitute a belt means for keeping the closures 15 moving downwardly, rather than being stopped by the sprays of high-pressure water and air used for cleaning the closures 15. The belt means is necessary for continued downward movement of the closures 15 when water and air sprays are directed generally normal to the cap portions 15*a*.

Figure 6:
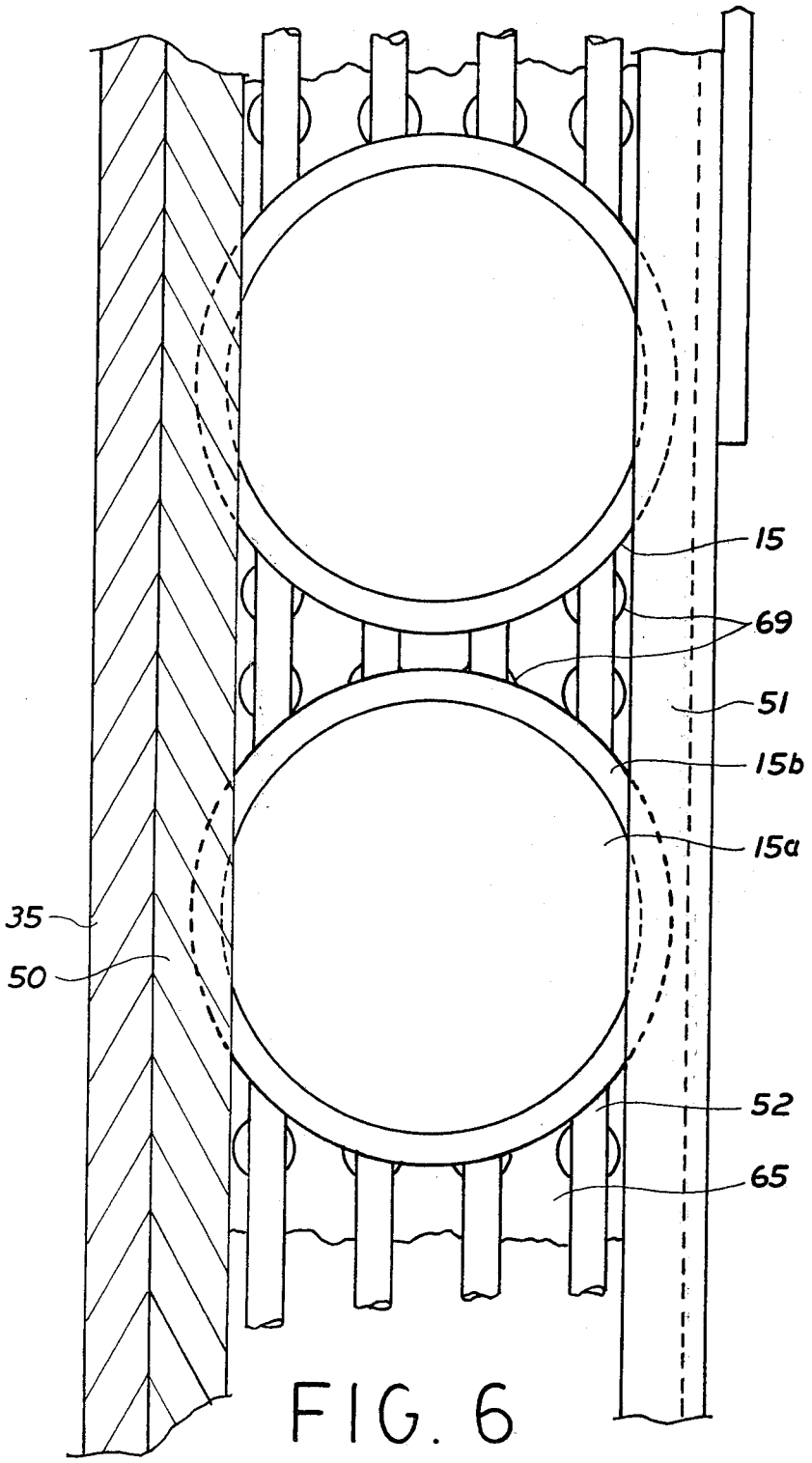
FIG. 6 is a fragmentary, cross-sectional view taken along the lines 6—6 of FIG. 2.

As shown in FIGS. 2 and 5, principal sections 52 of the belts 53 are backed by a dead plate 65 extending laterally between adjacent belts 53. A rearward end 66 of the dead plate 65 is affixed to the rear wall 35, and a forward end portion 67 is attached to the guide bracket 51. In the embodiment illustrated in FIG. 5, the guide bracket 51 is attached to the dead plate 65 in a position to accommodate closures having a diameter of 38 mm. Position of the guide bracket 51 can be reversed to accommodate 28 mm diameter closures by removing a screw 67 attaching the bracket 51 to the plate 65, then rotating the bracket 51 by 180° to place an opposite side of the bracket 51 adjacent the path of the closures and replacing the screw 67. The dead plate 65 limits displacement of the principal section 52 of the belts 53 upon exposure to the water and air sprays. The dead plate 65 defines several through openings 69 (see FIGS. 5 and 6) that expedite flow of water and air past the closures 15.

Water mixed with contaminants removed from the closures 15 forms a small pool 70 on the floor of the enclosure 33 adjacent the bottom wall 38. The contaminated water 70 is drained from the enclosure through a drain orifice 71 comprising an opening in the bottom wall 38, as shown in FIG. 2. The drain orifice 71 empties water into a drain tube 72 extending downwardly to a drain trough 73 beneath the chute 17, illustrated in FIG. 1. The drain trough 73 is emptied by an outlet tube 74 adjacent a lower end portion of the trough 73. Several high pressure air jets enter the drain tube 72 through a pipe 75 having several outlets 76 intermediate the orifice 71 and trough 73, as shown in FIGS. 1 and 2. The high pressure air stream entering the drain tube 72 reduces pressure within the enclosure 33, thereby forcing water within the enclosure 33 to drain through the orifice 71. Creation of a zone of negative (less than atmospheric) pressure within the enclosure 33 also limits any tendency of water to splash upwardly through the discharge channel 16 to the hopper 13.

EXAMPLE

The effectiveness of the closure cleaning apparatus of the invention was tested on 28 and 38 mm diameter aluminum bottle caps having white polyvinyl chloride cap liners. The caps were placed in a one-quart container approximately 20 to 30 at a time together with 20 to 45 mg of dust collected from the proximity of hoppers in a beverage container manufacturing line. The dust was thoroughly mixed with the caps. After excess dust was tapped from each cap, the cap liner was cross scored with a knife to aid in counting. The number of dust particles on each liner was counted and recorded. Although most dust particles were visible with the unaided eye, a 10X microscope was used to enhance counting speed and accuracy. Average dust count prior to treatment in the apparatus was approximately 300 particles per cap, with a standard deviation of 55. Differences in the counts before and after cleaning were the basis for all test results.

The effect of cap feed rate on cleaning efficiency was measured as follows on 28 mm diameter caps.

| Cap feed rate (caps/min) | Cleaning efficiency (% removal) |
|---|---|
| 400 | 94% |
| 600 | 93% |
| 800 | 92% |
| 1,000 | 89% |

On 38 mm diameter caps, the effect of cap feed rate was measured as follows:

| Cap feed rate (caps/min) | Cleaning efficiency (% removal) |
|---|---|
| 0 | 88% |
| 250 | 88% |
| 400 | 90% |
| 600 | 77% |

The above results were the best obtained based upon various tests using different air and water pressures and different nozzle sizes and types. In individual tests, the lowest measured cleaning efficiency was 75% removal and the highest was 95% removal. For both 28 mm and 38 mm diameter caps, optimum cleaning efficiency was achieved at a cap feed rate of 400 caps/min.

With the foregoing detailed description of a preferred embodiment of my invention in mind, persons skilled in the art will understand that numerous changes and modifications can be made without departing from the spirit and scope of the invention. For example, the atomized water jet nozzle 43, described above, could be replaced by a high pressure water nozzle. The following claims are intended to include all such changes and modifications in my invention.

What is claimed is:

1. In an assembly including a hopper holding container closures including cap portions and skirt portions extending outwardly of the cap portions, a capping machine spaced downwardly from said hopper, and an apparatus for removing contaminants from inner surfaces of the closures while the closures are traveling downwardly from said hopper to said capping machine;

the improvements wherein said apparatus comprises liquid spray means for directing a generally horizontal spray of liquid against inner surfaces of the cap portions of said closures, gas spray means for removing liquid from the closures, said gas spray means directing a generally horizontal stream of gas against the inner surfaces of the cap portions of said closures, said gas spray means being spaced downwardly from the liquid spray means, an enclosure limiting spray of liquid beyond the apparatus, belt means forcing the closures past the liquid and gas spray means and controlling the rate of travel of the closures, said belt means comprising a plurality of laterally spaced, flexible endless belts having downwardly traveling principal sections inside the enclosure frictionally engaging the cap portions of the closures, and an elongated, generally vertical chute having a pair of opposed fixed side walls defining an elongated pathway for the closures, each of said side walls including a generally planar vertical panel extending laterally of and in proximity to skirt portions of the closures from the cap portions to mouth openings of the closures, said chute maintaining the cap portions generally vertical.

2. The apparatus of claim 1 further comprising at least two vertically spaced pulleys mounted on parallel, vertically spaced axles, said belt means including first and second vertically spaced end portions passing vertically externally of said pulleys in contact therewith, and motor means joined to at least one of said axles for driving said pulleys at a controlled velocity.

3. The apparatus of claim 1 wherein said belts are made of an organic polymeric material.

4. The apparatus of claim 3 wherein said organic polymeric material is rubber or plastic.

5. The apparatus of claim 1 wherein the principal section of each of said belts includes an exterior surface portion for engagement with the closures and an interior surface portion opposite said exterior surface portion, and further comprising a generally vertical plate adjacent said interior surface portion and extending laterally between said belts, said plate limiting lateral displacement of the principal section during exposure to the liquid and gas spray means.

6. The apparatus of claim 1 further comprising a drain for removing liquid from inside the enclosure.

7. A method for removing contaminants from inner surfaces of container closures during travel from a hopper to a capping machine spaced downwardly from the hopper, said closures including cap portions and skirt portions extending outwardly of the cap portions, said method comprising the steps of transferring the closures downwardly from the hopper to the capping machine while simultaneously confining the closures in an elongated generally vertical chute having a pair of opposed fixed side walls defining an elongated pathway for the closures;

orienting the closures in said chute to maintain said cap portions generally vertical;

directing a generally horizontal spray of water against inner surfaces of the cap portions of said closures;

directing a generally horizontal spray of air against inner surfaces of the cap portions of said closures, thereby to remove water from said closures;

forcing the closures downwardly past said spray of water and said spray of air by frictionally engaging the cap portions of said closures with vertically oriented, generally downwardly traveling principal sections of a plurality of laterally spaced, flexible endless belts made of an organic polymeric material;

enclosing the spray of water within an enclosure; and draining water from the enclosure.

8. The method of claim 7 further comprising the step of transferring the closures through the chute to a capping machine at a rate of at least 250 closures per minute.

9. The method of claim 8 wherein the capping machine operates at a rate of about 400 to 1000 closures per minute, and closures are transported through the chute at a rate of about 400 to 1000 closures per minute.

10. The method of claim 7 wherein said enclosure defines a zone of subatmospheric pressure.

* * * * *